US012553651B2

(12) United States Patent
Hays et al.

(10) Patent No.: US 12,553,651 B2
(45) Date of Patent: Feb. 17, 2026

(54) APPARATUS FOR MAKING STYLIZED ICE CUBES

(71) Applicants: David Hays, Houston, TX (US); Joshua Harris, Houston, TX (US)

(72) Inventors: David Hays, Houston, TX (US); Joshua Harris, Houston, TX (US)

(73) Assignee: David Hays, Houston, TX (US)

( * ) Notice: Subject to any disclaimer, the term of this patent is extended or adjusted under 35 U.S.C. 154(b) by 216 days.

(21) Appl. No.: 18/246,181

(22) PCT Filed: Sep. 29, 2021

(86) PCT No.: PCT/US2021/052637

§ 371 (c)(1),
(2) Date: Mar. 21, 2023

(87) PCT Pub. No.: WO2022/081339

PCT Pub. Date: Apr. 21, 2022

(65) Prior Publication Data

US 2023/0366602 A1 Nov. 16, 2023

Related U.S. Application Data

(60) Provisional application No. 63/091,438, filed on Oct. 14, 2020.

(51) Int. Cl.

| | |
|---|---|
| ***F25C 1/04*** | (2018.01) |
| *F25C 1/24* | (2018.01) |
| *F25C 1/243* | (2018.01) |

(52) U.S. Cl.
CPC ..... *F25C 1/04* (2013.01); *F25C 1/24* (2013.01); *F25C 1/243* (2013.01)

(58) Field of Classification Search
CPC .... F25C 1/04; F25C 1/24; F25C 1/243; F25C 1/246; F25C 2500/02; A23G 3/221
See application file for complete search history.

(56) References Cited

U.S. PATENT DOCUMENTS

| | | | | |
|---|---|---|---|---|
| 1,817,545 | A | 8/1931 | Copeman | |
| 2,291,672 | A | 8/1942 | Youngberg | |
| 2,514,942 | A | 7/1950 | Eaton | |
| 3,661,353 | A | 5/1972 | Newsteder | |
| 4,222,547 | A | 9/1980 | Lalonde | |
| D804,546 | S | 12/2017 | Richardson | |
| D804,547 | S | 12/2017 | Richardson | |
| 2005/0095334 | A1 | 5/2005 | Messina | |
| 2015/0107275 | A1* | 4/2015 | Papalia | F25C 1/04 62/340 |

OTHER PUBLICATIONS

"Silicone Ice Cube Tray: The Kitchen Tool You Didn't Know You Needed" (McDowell), [online], retrieved from <URL: https://foodandnutrition.org/blogs/stone-soup/silicone-ice-cube-tray-the-kitchen-tool-you-didnt-know-you-needed/>.

* cited by examiner

*Primary Examiner* — Joseph F Trpisovsky
(74) *Attorney, Agent, or Firm* — Werner IP Law, P.C.

(57) ABSTRACT

An ice molding apparatus which has a cell or space formed by a peripheral wall and a bottom wall, a recess being formed in the bottom wall. There is an insert which is selectively, releasably receivable in the recess. The insert has a top surface which includes a formation which can be either projecting or receiving.

10 Claims, 4 Drawing Sheets

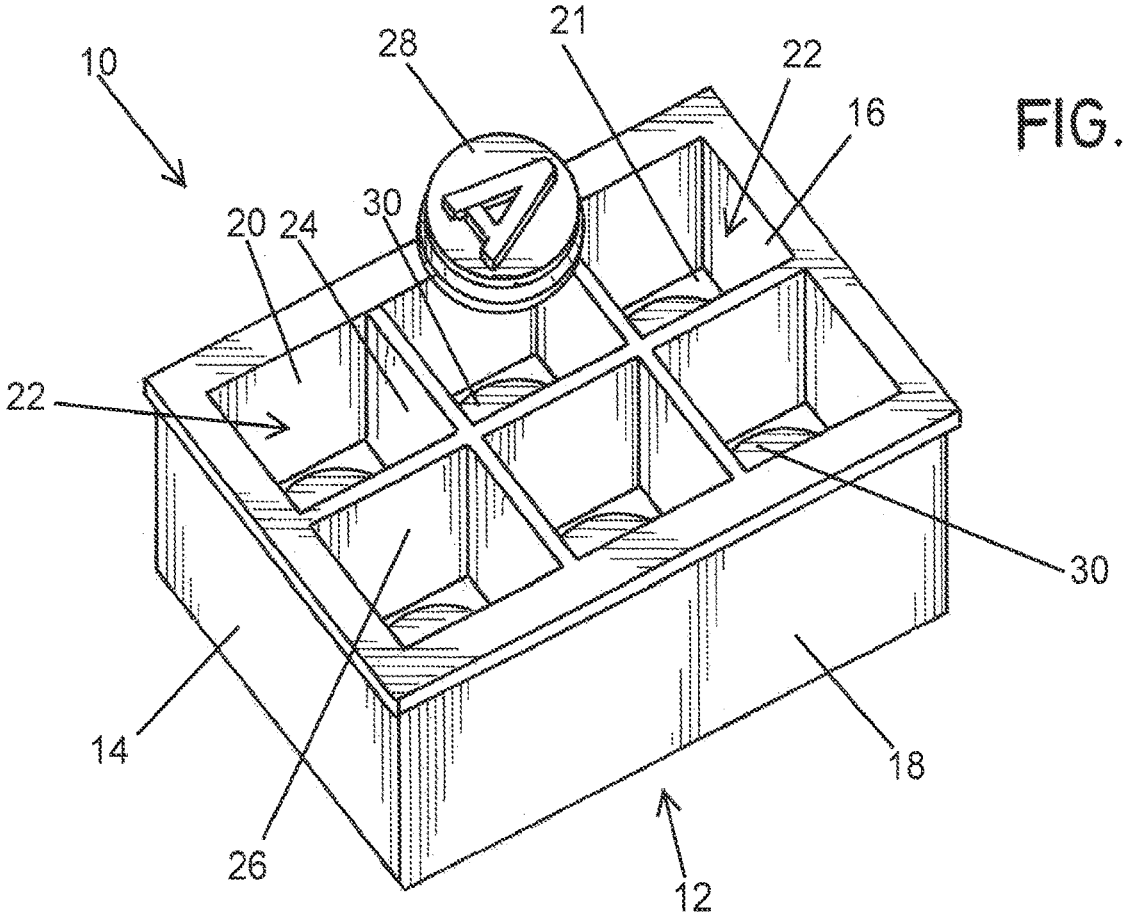
FIG.1
FIG.7
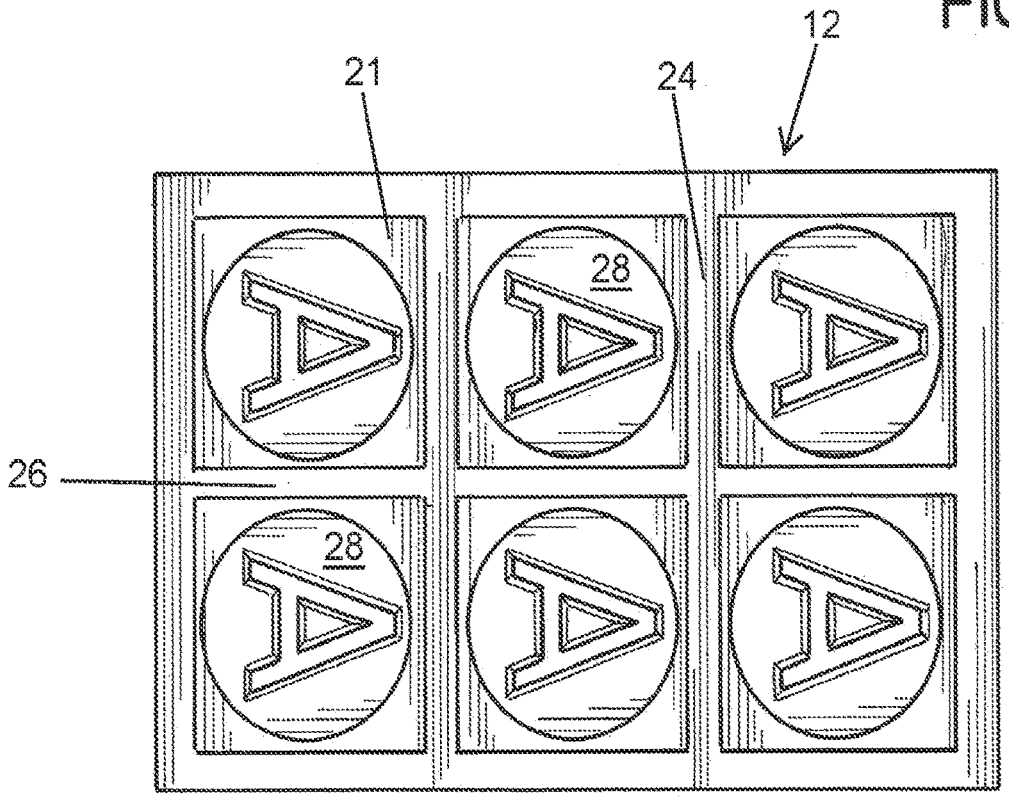

APPARATUS FOR MAKING STYLIZED ICE CUBES

FIELD OF THE INVENTION

The present invention relates to an apparatus for making ice cubes and, more particularly, to an apparatus for making stylized ice cubes.

BACKGROUND OF THE INVENTION

Ice cube trays which can be used to form spherical or cubical ice cubes are well known and popular in cocktails served in bars as well as homes. In the case of forming ice spheres, the ice cube tray comprises a bottom half having generally hemispherical cavities therein while the top half likewise has hemispherical cavities therein, the top half being placed over the bottom half and then water being introduced into the thus formed spherical cavity via a fill hole in the top half of the tray. It is also known to make cubical ice cubes of a large size relative to ordinary ice cubes.

Ice cube trays are known for making ice cubes of a desired shape. U.S. Pat. No. 4,222,547 discloses an ice tray for making ice cubes having a configuration which allows the individual cubes/pieces to be removed on a one-at-a-time basis. U.S. Pat. No. D804,546 discloses an ice cube tray wherein an ice cube can be in the shape of a D or an A so as to make ice cubes which spell out "DAD". Similarly, U.S. Pat. No. D804,547 discloses an ice cube tray which can be used to form the letter M and O so as to make ice cubes which spell out "MOM".

SUMMARY OF THE INVENTION

In one aspect, the present invention relates to an apparatus for making stylized ice cubes.

In another aspect, the present invention relates to an apparatus for making stylized ice cubes such that a surface of the ice cube produced comprises a relief/outthrust.

In still a further aspect, the present invention relates to an apparatus for making stylized ice cubes wherein a surface of the ice cube produced comprises a depression formed in the surface of the ice cube.

In yet another aspect, the present invention relates to an ice cube making apparatus comprising a cell having a bottom wall, the bottom wall having a recess and an insert which can be selectively positioned in the recess, the insert having a top surface including a formation which can be projecting or receiving.

In another aspect, the present invention relates to an ice cube making apparatus having a tray with a plurality of cells and a cover for making a plurality of stylized ice cubes.

These and further features and advantages of the present invention will become apparent from the following detailed description, wherein reference is made to the figures in the accompanying drawings.

BRIEF DESCRIPTION OF THE DRAWINGS

FIG. 1 is a perspective view of one embodiment of an ice cube making apparatus of the present invention and shows a tray having a plurality of cells and an insert selectively positionable in one of the cells.

FIG. 7 is a top plan view and shows the embodiment of FIG. 1 wherein the inserts are received in the recesses in the cells of the tray.

DETAILED DESCRIPTION OF PREFERRED EMBODIMENTS

Figure 2:
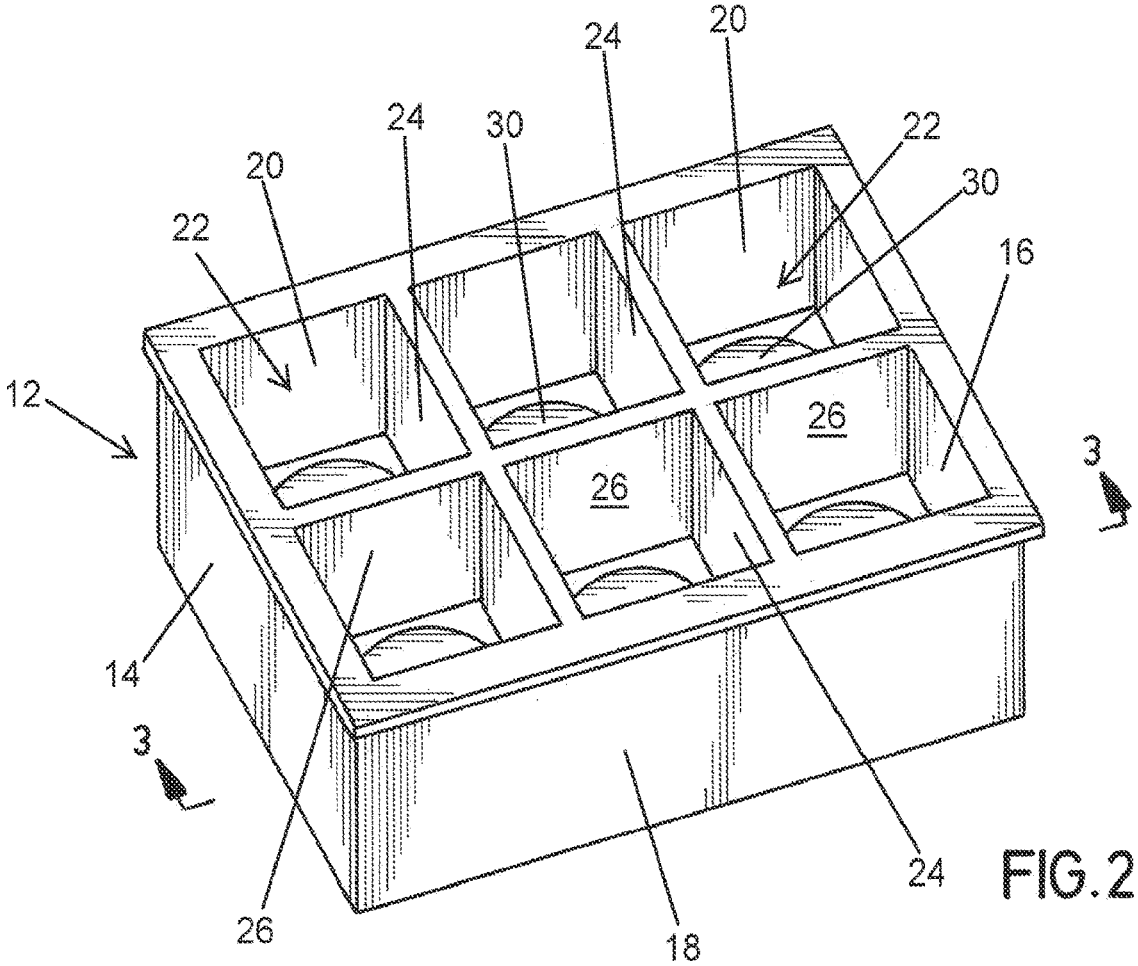
FIG. 2 is a perspective view of the tray of FIG. 1.

As used herein the term "ice cube(s)" when referring to the ice formations which can be made according to the present invention, means a body of ice which can be of any geometric shape, but which has at least one surface in or on which is formed a relief/outthrust, a depression/recess, or both. Although water is commonly used in making the ice cubes, using the apparatus of the present invention, it will be appreciated that other "freezable" formable substances can be used if desired.

Referring first to FIGS. 1 and 7, there is shown one embodiment of the ice cube making apparatus of the present invention. The apparatus, shown generally as 10, comprises a tray shown generally as 12, tray 12 having a first end wall 14, a second spaced end wall 16, a first side wall 18, a second spaced side wall 20, and a bottom wall 21, walls 14, 16, 18, 20, 21 cooperating to form a rectangular body in which are formed a plurality of cells shown generally as 22. Cells 22 are formed by a combination of peripheral wall sections 14, 16, 18, 20, bottom wall 21, and interior partitions such as 24 and 26. Thus, and as seen, tray 12 comprises six cells 22, each of which has a peripheral wall as described above formed by the peripheral wall sections 14, 16, 18, 20 and the partitions 24 and 26. As shown, the cells are monolithically formed in the body of the tray 12. However, individual separate cells could be placed in an open tray, if desired.

Also shown in FIG. 1 are six inserts shown generally as 28, each of which is receivable in a respective recess 30, formed in the bottom wall 21 in each of the cells 22, and each of which has a top surface with a relief for making stylized ice cubes which display an "A".

As can be seen in the described embodiment shown in the drawings, the cells 22 are rectangular. However, it is to be understood that the cells 22 could be cylindrical, or for that matter, any other shape, the proviso being that the ice cubes formed can be released from the tray 12.

Figure 3:
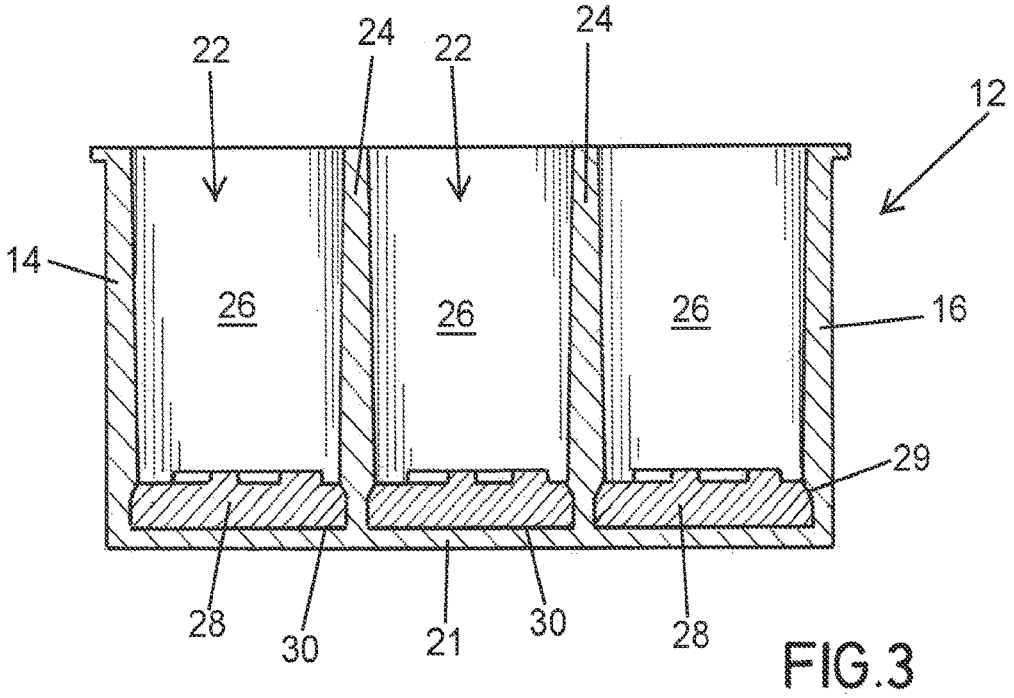
FIG. 3 is a cross-sectional view taken along lines 3-3 of FIG. 2.

Turning now to FIGS. 2 and 3, it can be seen that the inserts/discs 28 are in the recesses 30 formed in the bottom wall 21 of the cells 22. As best seen in FIG. 3, recesses 30 have a peripheral wall 29 which is complementary to the peripheral wall of the insert 28. It will be recognized that in the embodiment shown in the figures, because of the geometry of the peripheral surface of the disc 28, the disc 28 fits snugly into the recesses 30. The geometry of the recess 30 coupled with the geometry of the disc 28 generally require that the insert 28 or the tray 12, or both are made of a flexible material, e.g., silicone rubber, to allow positioning of the inserts 28 in the recesses 30. Thus, the inserts 28 effectively snap into the recesses 30, the flexibility of the tray 12 allowing the insert 28 to completely fill the volume of the recess 30.

Figure 4:
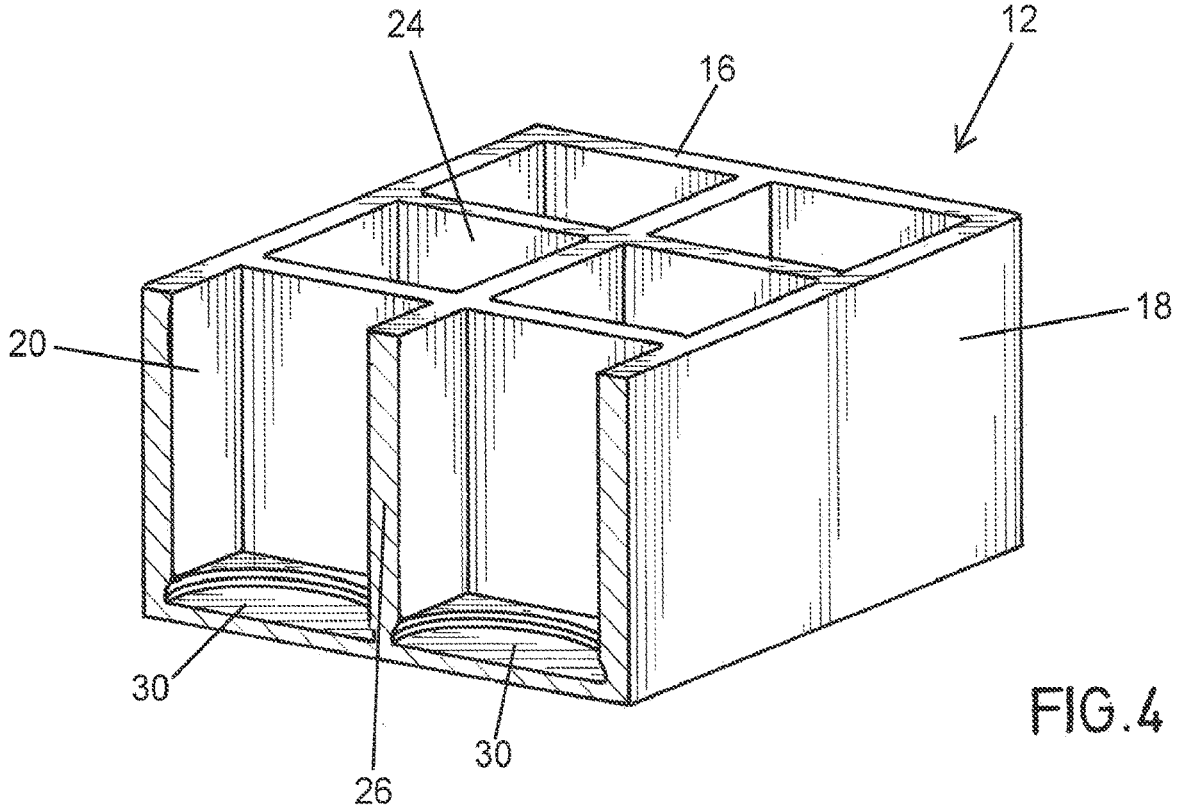
FIG. 4 is a perspective view, partly in section, of a tray in accordance with one embodiment of the present invention.
Figure 5:
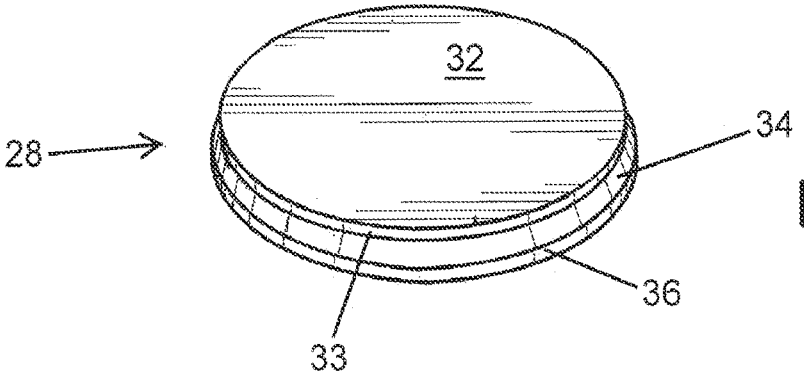
FIG. 5 is a perspective view of an insert for use in the ice making apparatus of the present invention.
Figure 6:
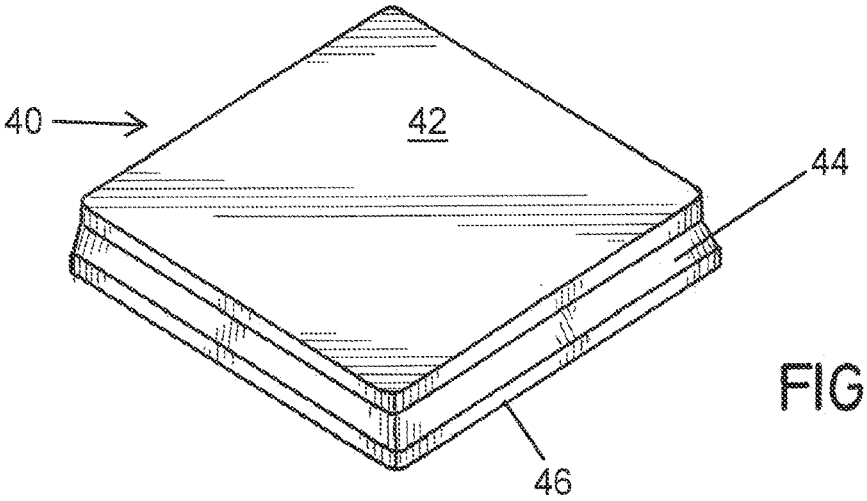
FIG. 6 is a perspective view of anther insert for use in the ice cube making apparatus of the present invention.

Turning now to FIGS. 4-6, there is shown in greater detail the recesses 30 at the bottom of the cells 22 as well as the geometry of the insert 28. As can be seen from FIG. 5, insert 28, which is a circular disc, has a top crown portion 32, a frustoconical peripheral wall section 34, and a bottom, cylindrical wall section 36. Cylindrical wall section 36 in the embodiment shown in FIGS. 4 and 5 is simply for purposes of molding the insert 28 and more particularly, to allow easy release of the insert 28 from the mold.

Crown portion 32 forms a generally planar surface 38, crown portion 32 having a reduced diameter peripheral surface 33 forming an annular step between peripheral wall section 34 and crown portion 32.

As can be seen in FIG. 6, the inserts can be rectangular as shown by insert 40. Insert 40 has a planar crown portion 42 from which downwardly extends a peripheral, chamfered wall section 44 and a straight peripheral wall section 46 extending downwardly from chamfered wall section 44. FIGS. 5 and 6 demonstrate the versatility of the ice making apparatus of the present invention in that the inserts can be of virtually any shape, the proviso being that the recesses have a shape complementary to the shape of the insert so as to achieve the "snap in" insertion of the insert into the recess. It should also be appreciated, as noted above, that the inserts, whatever their shape, will basically fill the recesses. This ensures that water or other freezable liquid does not, to any appreciable extent, get trapped between the insert and the recess surfaces.

Figure 8:
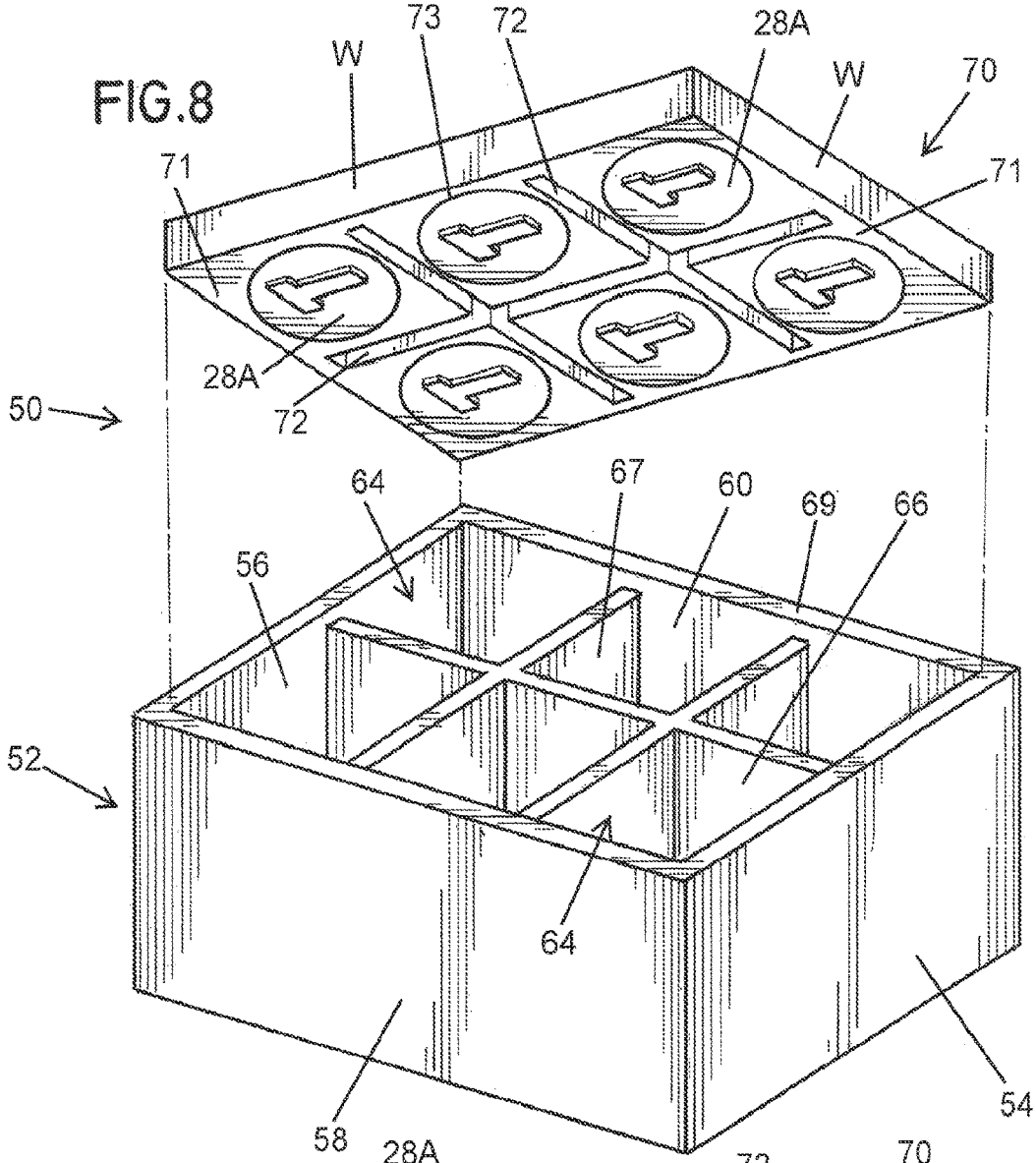
FIG. 8 is a perspective view of another embodiment of the ice cube making apparatus of the present invention having a try with a plurality of walls and a cover plate for making stylized ice cubes wherein the insert is configured to form a depressed T in the surface of the ice cube.
Figure 9:
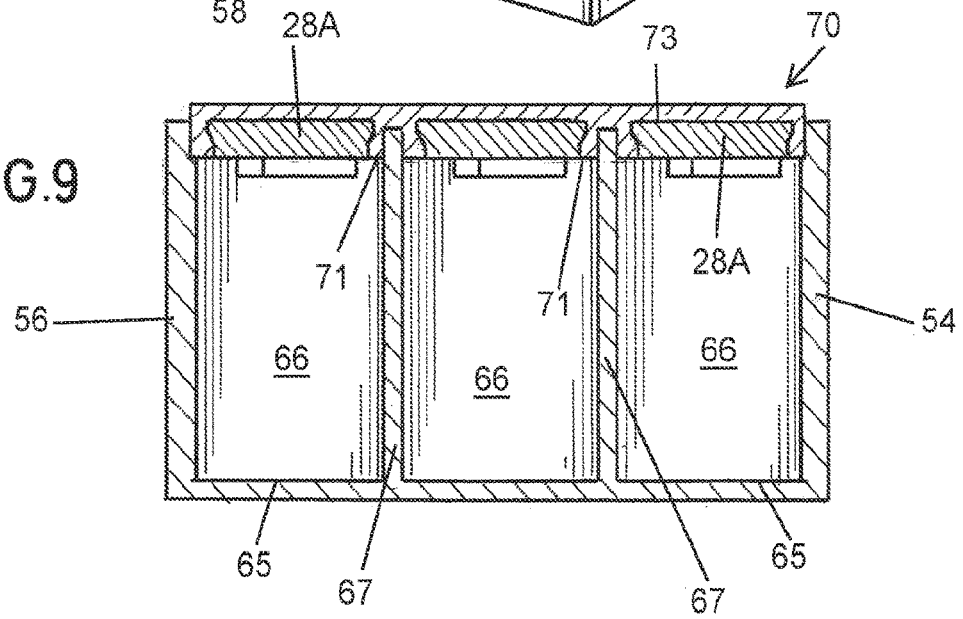
FIG. 9 is a cross-sectional view of the ice cube making apparatus of FIG. 8.

Turning now to FIGS. 8 and 9, there is shown another embodiment of the present invention. The ice tray apparatus of the present invention, shown generally as 50 in FIG. 8, comprises a tray 52 formed by a first end wall 54, opposed second end wall 56, a first side wall 58, and a second side wall 60. A series of cells shown generally as 64 are formed by a combination of walls 54-60, and partitions 66 and 67, and bottom wall 65.

As can be seen from FIG. 8, the peripheral walls of tray 52 at their upper ends form a rectangular frame 69.

The embodiment of FIGS. 8 and 9 includes a rectangular cover or plate shown generally as 70, plate 70 having a peripheral wall W. Plate 70 also includes a downwardly facing planar surface 71, there being a plurality of slots 72 through plate 70. Plate 70 also has a series of recesses 73 in which are received inserts 28A. A grid is formed in tray 52 by the upper ends of partitions 66, 67. When plate 70 is positioned in the frame 69, the slots 72 are in register with the partitions 66, 67 such that plate 70 nests into tray 52. Thus, when the cells 64 are filled with water or the like, the T outthrusts on inserts 28 extend into the space formed by cells 64. In general, in the process of filling the cells 64 and nesting the plate 70 in the frame 69, water will be forced out between the plate 70 and the tray 52, meaning that the cells 64 will be completely filled. In this regard, and optionally, the tray can have one or more suitable bleed holes to force any excess water out of the cells while ensuring that water completely fills the cells 64 and the outthrusts T extend into the water.

In a modification of the embodiment shown in FIGS. 8 and 9, there would be a single cell and the cover plate would comprise a single recess. When the cell is filled with water, the cell could be inverted such that the cover would now form a bottom wall. Thus, there would be no necessity to fill the cell. The snug fitting between the cover plate and the cell would prevent water seepage with the cell in the inverted position.

Exemplary inserts 28 and 28A have outthrust formations on their upper surface or crown. Accordingly, ice cubes made using those inserts will have a surface depression in the form of an A or a T, respectively. If instead, discs 28 and 28A were made with depressions in the shape of an A or a T, the surface of the resulting ice cubes would then have outthrusts of the letters A and T.

Thus, if an outthrust or relief is desired on a surface of an ice cube to be made in accordance with the present invention, the inserts or discs, and more specifically, the top surface thereof, will have a receiving formation or depression which is basically the negative image of the outthrust desired. It will be apparent that an unlimited number of stylized ice cubes having different outthrusts can be formed simply by using discs or inserts having the desired depressions in the top surface thereof. Non-limiting examples of depression shapes which can be used to form the outthrust include letters, numbers, symbols, logos, words, textures, etc. Indeed, there are an endless number of ice cubes with different outthrusts that can be made.

In short, when the insert of the apparatus of the present invention has a surface with an indentation or depression of whatever shape, the resulting ice cube will have an outthrust or relief corresponding to that shape.

Thus, in forming ice cubes with outthrusts on the surface, the inserts or discs of the present invention can have crowns or top surfaces on which are formed outthrusts or reliefs such that the surface of the ice cube formed on the disc will have depressions, indentations or other inwardly extending formations which correspond to the outthrusts on the disc.

Although the preferred materials of construction of both the cells and the inserts is silicone rubber, a wide variety of materials can be employed. However, silicone rubber is preferred because it retains flexibility at low temperatures. Thus, it facilitates both insertion of the inserts as well as extraction of the formed ice cubes.

Although specific embodiments of the invention have been described herein in some detail, this has been done solely for the purposes of explaining the various aspects of the invention and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. An ice molding apparatus comprising:

a cell having a peripheral wall and a bottom wall;

a recess in said bottom wall;

an insert releasably receivable in said recess, said insert having a crown portion, said crown portion forming a top surface, said top surface including a formation, wherein said insert has a peripheral wall comprising an upper chamfered portion adjacent said crown portion, and a lower straight portion.

2. The apparatus of claim 1, wherein said formation comprises a depression.

3. The apparatus of claim 1, wherein said formation comprises an outthrust.

4. The apparatus of claim 1, further comprising:

a tray having a plurality of said cells.

5. The apparatus of claim 4, wherein cells are formed monolithically with said tray.

6. The apparatus of claim 5, wherein said tray is made of silicone rubber.

7. The apparatus of claim 6, wherein said insert is made of silicone rubber.

8. The apparatus of claim 1, wherein said cell is rectangular in cross-section.

9. The apparatus of claim 1, wherein said insert is one of rectangular and disc shaped.

10. The apparatus of claim 9, wherein said recess has a shape complementary to that of said insert, whereby said insert snugly fits into said recess.

* * * * *